US005848647A

United States Patent [19]

Webre et al.

[11] Patent Number: 5,848,647

[45] Date of Patent: Dec. 15, 1998

[54] PIPE GRIPPING APPARATUS

[75] Inventors: Mike Webre; Vernon Bouligny; Donald Mosing, all of Lafayette, La.

[73] Assignee: Frank's Casing Crew & Rental Tools, Inc., Lafayette, La.

[21] Appl. No.: 748,450

[22] Filed: Nov. 13, 1996

[51] Int. Cl.[6] ..... E21B 19/06; E21B 19/10

[52] U.S. Cl. ..... 166/379; 166/75.14; 166/77.52; 166/382; 175/423; 188/67

[58] Field of Search ..... 175/423; 166/77.52, 166/75.14, 77.1, 379, 382; 188/67

[56] References Cited

U.S. PATENT DOCUMENTS

| | | | |
|---|---|---|---|
| 1,541,669 | 6/1925 | Summers | 175/423 |
| 2,063,361 | 12/1936 | Baash | 175/423 |
| 3,748,702 | 7/1973 | Brown | 188/67 |
| 4,354,706 | 10/1982 | Coyle, Sr. | 294/102 A |
| 4,381,584 | 5/1983 | Coyle, Sr. | 24/263 D |
| 4,715,456 | 12/1987 | Poe, Jr. et al. | 175/423 |
| 5,335,756 | 8/1994 | Penisson | 188/67 |
| 5,484,040 | 1/1996 | Penisson | 188/67 |
| 5,609,226 | 3/1997 | Penisson | 188/67 |

OTHER PUBLICATIONS

Bilco Tools, Inc. brochure on Precision Slips & Elevators, Word Oil, Jan. 1996.

*Primary Examiner*—Hoang C. Dang
*Attorney, Agent, or Firm*—Matthews, Joseph, Shaddox & Mason, P.L.L.C.; Henry L. Ehrlich

[57] ABSTRACT

A pipe gripping apparatus for angularly adapting to misaligned pipe on one or more pipe strings, said apparatus comprising: a housing having internal, opposing, downwardly curved surfaces therein and forming a longitudinal opening for passing a portion of at least one tubing string therethrough; a plurality of slip carriers each having an exterior surface contoured to match said downwardly curved surface and having a downwardly inclined interior surface, each said slip carrier being in movable connection with one of said curved surfaces of said housing; a plurality of slips having downwardly inclined exterior surfaces and longitudinal channels formed on an internal surface for holding gripping elements for gripping a portion of the pipe, each said slip being in sliding engagement with one of said slip carriers; and a lifting mechanism having a securing arm in connection between each pair of said opposing slips.

12 Claims, 5 Drawing Sheets

PIPE GRIPPING APPARATUS

BACKGROUND OF THE INVENTION

The present invention relates to an pipe gripping apparatus for running, retaining, and angularly adapting to misaligned pipe in a tubing string. Traditional elevators and/or spiders contain a plurality of slips circumferentially surrounding the exterior of the pipe which are housed by what is commonly referred to as a "bowl." Generally, the apparatus is engaged by placing it around a given section of the pipe in a tubing string. The radial interior surface of the slips typically form or carry hard metal teeth for gripping the pipe. The exterior surface of the slips and interior surface of the bowl usually have opposing engaged surfaces which are inclined radially inward and downwardly. In certain embodiments of the apparatus, the mating surfaces between the slips and bowl serve to inject the slip and gripping elements in a longitudinal and radial direction in relation to the pipe for engagement or disengagement of the pipe. Thus, when the weight of the pipe in the tubing string is lowered into the apparatus, it engages the gripping elements on the slips, causing them to move downward in relation to the bowl and radially inward for securing the pipe. This process is commonly referred to in the industry as a "fail safe" method of engaging the pipe for movement either down into the wellbore or in removal of the pipe from the wellbore due to the "self tightening" feature of the apparatus.

During traditional wellboring operations, a spider which houses the slips, is located near the rotary table and is used for securing pipe in the well. An elevator is suspended from the rig hook, which is used for running or retrieving the tubing string. In a typical operation, the spider remains stationary to secure the pipe, while the elevator engages the pipe by "self tightening" as described above. The spider then disengages from the pipe when the slips are radially removed away from the tubing string, allowing the elevator to move the tubing string relative to the rotary table as needed. The spider then reengages the pipe, allowing the elevator to continue running or removing the tubing string.

Slip and elevator devices have varied over the years. However, their overall basic function and concomitant problems have not changed. For example, U.S. Pat. No. 4,381,584 to Coyle, Sr., and U.S. Pat. No. 4,354,706 to Coyle, Sr. provide for a dual string spider and/or elevator which cannot angularly adjust. The Coyle, Sr. patents disclose slips which merely function to secure the pipe in a tubing string when engaged by a gripping means, and are incapable of angularly adjusting in any plane or direction relative to movement of the pipe in a tubing string that becomes misaligned. Consequently, the pipe may become misaligned due to unevenly weighted multiple tubing strings or angular misalignment between the vertical axis of the spider and that of the wellbore, resulting in high stress and possible damage to the pipe in the tubing string.

U.S. Pat. No. 5,335,756 to Penisson only addresses drilling operations for a single string, and is restricted in its radial movement of the slips and/or gripping elements. Furthermore, Penisson does not provide a gripping assembly which can angularly align itself as an entire unit without relative movement between some or all of the gripping elements and the surface of the pipe.

The Pennisson device discloses a tool which has a plurality of slip assemblies and provides some alignment capability however, does not address the need for angular readjustment of the slips in any plane or direction which can become misaligned during retrieval or placement of the pipe in a tubing string. Pennisson discloses a single string device where each slip assembly pivots on an axis at or near its own physical center, causing a variety of problems. For example, once the tubing string is secured in the device, it is incapable of adjustment relative to the device itself. Moreover, if the tubing string is not angularly aligned with the longitudinal axis of the device, the slips do not directly oppose each other and therefore, are incapable of independent angular movement which could result in relative movement between the tubing string and gripping elements, causing the pipe in the string to bend.

The present invention provides a plurality of slip assemblies which pivot about a common center which is aligned with the center of the tubing string making it possible for the plurality of slip carriers to self align as a unit, even after the tubing string has been secured. Thus, the present invention is "self aligning" because the slips directly oppose each other, regardless of movement of the tubing string after it is secured.

SUMMARY OF THE INVENTION

The present invention relates to an improved pipe gripping apparatus which comprises a longitudinal opening having a pair of opposing downwardly curved interior surfaces or "bowls" which are releasably attached for placement of the pipe in a tubing string. In its preferred embodiment, the longitudinal opening through the bowls forms a larger receptive opening at its top for engagement of two sets of slips and pivoting slip carriers, and narrows at its lower end for passage of tubing strings.

The longitudinal opening in the bowls is thus, concave which allows for angular realignment of the slip carriers, which are convexly contoured to rotationally mate with the interior concave surface of the bowls.

It is therefore, a primary object of the present invention to provide a means for improved angular realignment of each set of slips in the event that multiple tubing strings become unevenly weighted, or the vertical axis of the spider and wellbore become misaligned. Improved angular realignment is accomplished by virtue of the pivoting slip carriers which are capable of rotating in any plane or direction except torsionally about the axis of the pipe. The center of rotation of the pivoting slip carriers directly opposes each other and coincides with the center of the concave opening in the bowl. Thus, the present invention is "self aligning" by virtue of the slips which rotate about a common axis relative to the tubing string regardless of movement of the tubing center of the string after it is secured.

A lifting mechanism is connected to each set of slips and is secured to a corresponding set of slip carriers, for radial movement of the slips in positioning or retrieving the tubing string. The lifting mechanism may be mechanically operated or in its preferred embodiment, pneumatically or hydraulically operated. In its preferred embodiment, each lifting mechanism is capable of simultaneously engaging a set of slips on a given section of the pipe in a tubing string. The slip carriers form downwardly inclined interior surfaces for sliding engagement of each slip. Likewise, each slip forms a corresponding angularly inclined exterior surface for sliding engagement with each slip carrier and a channeled or grooved longitudinal interior surface for holding a plurality of gripping elements. The angularly inclined slotted exterior surface of each slip also forms a lateral opening through which a rod passes for securing the lifting mechanism and radial movement of the slips during placement or retrieval of the pipe in a tubing string.

The longitudinal interior surface of each slip forms a recess for housing the gripping elements which may be self contained or secured by a rod which passes longitudinally through the gripping elements and pivotally secures the same. The gripping elements facilitate securing the tubing string when the slips are engaged, and are capable of rotatably adjusting to any tubing string's diameter when pivotally secured within the slips by a rod, or translationally adjusting to any tubing string's diameter when self contained in the slips. In its preferred embodiment, each slip is capable of housing two sets of longitudinally disposed gripping elements. Therefore, it is an object of the present invention to provide self adjusting gripping elements which are capable of uniformly adapting to various pipe diameters in a tubing string.

It is another object of the present invention to provide an improved pipe gripping apparatus capable of angularly adapting to single and multiple misaligned tubing strings in any direction or plane in order to reduce or eliminate any bending moment about the pipe in a tubing string caused by the pipe being restrained in an angular direction which does not precisely coincide with the tubing string axis. Thus, the objective and benefits of angular realignment when using the present invention as an elevator is to angularly adapt to the misaligned pipe in the tubing string so that its load is aligned with the center of the pipe when the wellbore platform is off center or multiple tubing strings are unevenly weighted. The same benefits are accomplished when the apparatus is used as a spider in the event that the wellbore floor is off center or the apparatus is used on a ship or offshore platform that is subject to pitching or unlevel surfaces during drilling or completion operations.

Additional details of the invention and/or various embodiments thereof, as well as various objects and advantages of the invention, will be made apparent by the following detailed description, the drawings and the claims.

DETAILED DESCRIPTION

Figure 1:
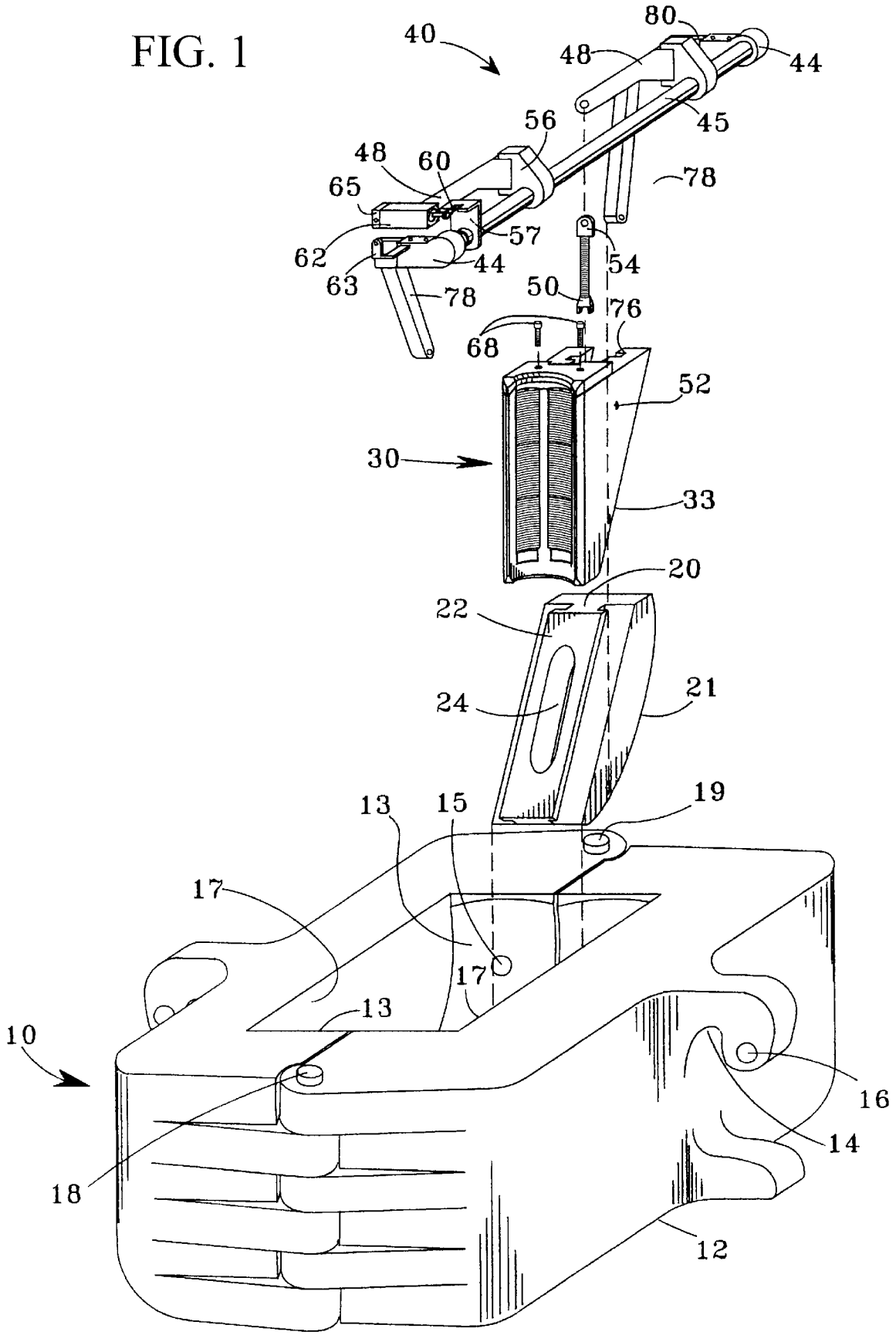
FIG. 1 is an isometric exploded view of the improved pipe gripping apparatus of the present invention, showing only one slip carrier, lifting mechanism, and slip for purposes of clarity.

In FIG. 1, an pipe gripping apparatus (10) is generally shown comprising a housing (12) which is hingedly connected at (18) and releasably secured at (19) to enable placement of the housing around the tubing string. Each half of the housing forms an opening longitudinally disposed therethrough with two opposing downwardly curved interior surfaces or bowls (13) for receipt of a tubing string (not shown). The longitudinal opening disposed through the housing additionally comprises two opposing longitudinal surfaces (17) generally perpendicular and adjacent to the downwardly curved interior surfaces (13).

Each downwardly curved interior surface (13) of the housing (12) is adapted to receive a correspondingly contoured exterior surface (21) of a slip carrier (20) for angular adaptation to the misaligned tubing string. In its preferred embodiment, the elevator and spider apparatus comprise two pair of opposing slip carriers (20) having a downwardly inclined interior surface (22) for sliding engagement of a corresponding number of slips (30). Each slip carrier (20) also contains an opening laterally disposed therethrough (24) for rotational engagement with the downwardly curved interior surface (13) of the housing (12) which is secured through opening (15) by a shoulder bolt assembly more particularly depicted in FIG. 3.

Each corresponding slip (30) has an opposing downwardly inclined exterior surface (33) in sliding engagement with the surface (22) of the slip carrier (20) through slot (76) of the slip (30). In its preferred embodiment, angular adaptation to the misaligned tubing string may be accomplished by rotational alignment of the slip carrier (20) in any direction or plane except torsionally about the axis of the pipe.

Figure 3:
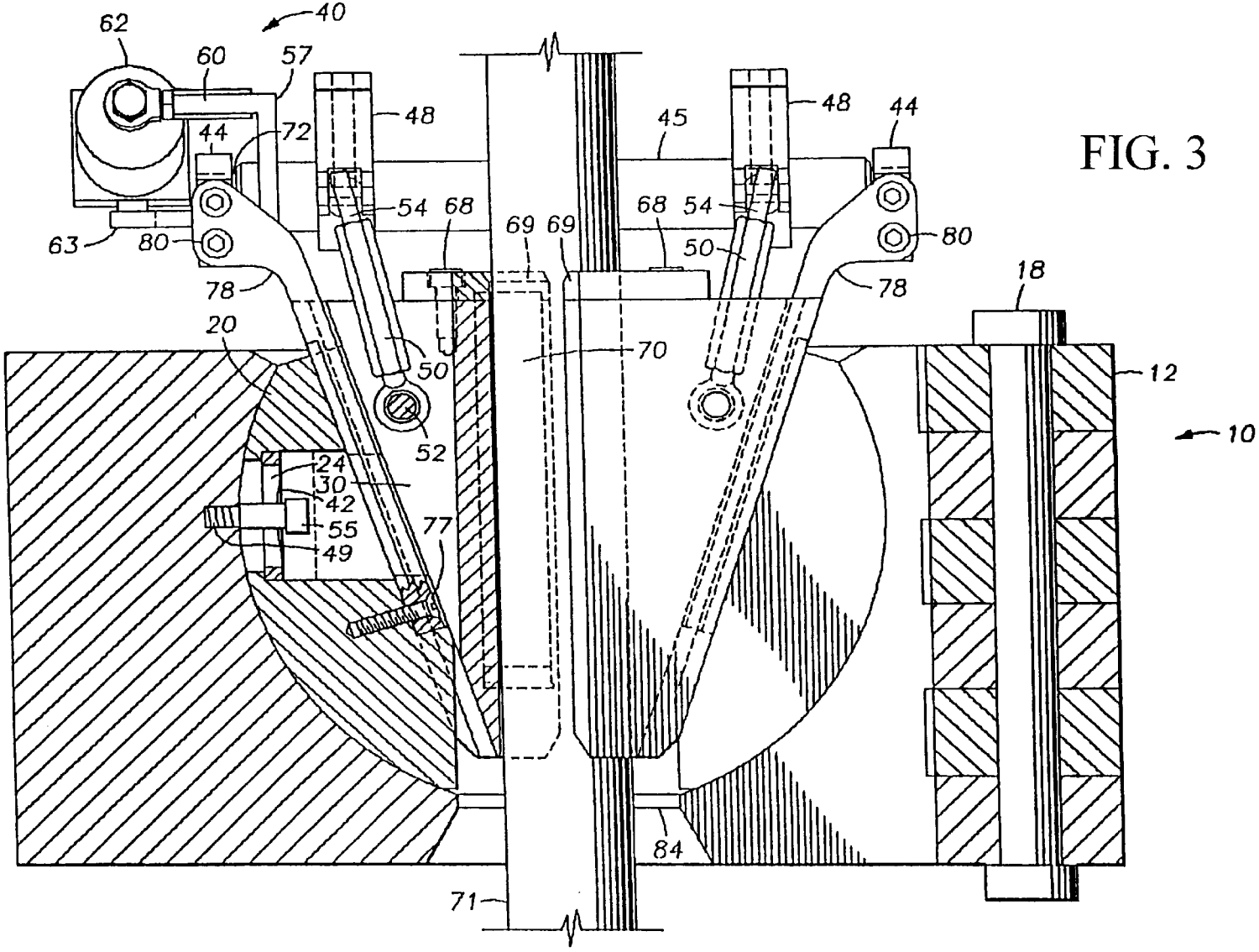
FIG. 3 is a cross sectional side view of the embodiment in FIG. 2.

The tubing string is releasably secured within the housing (12) by radially engaging the slips (30) around the tubing string, and may be similarly disengaged by inverse radial movement of the slips (30). Radial movement of each slip (30) is performed by a lifting mechanism (40) which is attached to each opposing set of slips (30) by a rod (52) passing through the slip (30) as shown in FIG. 3. The lifting mechanism (40) is powered by a pneumatic cylinder (62) which is secured by an actuator bracket (57), and tube arm rod (60) to a rotating tube (45). The rotating tube (45) is likewise secured to each rod (52) of the slip (30) by a female rod end (50) which is connected to a lifting arm (48) by a male rod end (54). Each lifting arm (48) is secured to the rotating tube (45) by a bracket (56). The entire lifting mechanism assembly (40) is secured at each end to corresponding opposing slip carriers (20) by a securing arm (78), which in turn is attached to the lifting mechanism pivot blocks (44) at 80. In its preferred embodiment, the lifting mechanism (40) provides simultaneous radial movement of each slip (30) for engaging or disengaging the tubing string.

Figure 2:
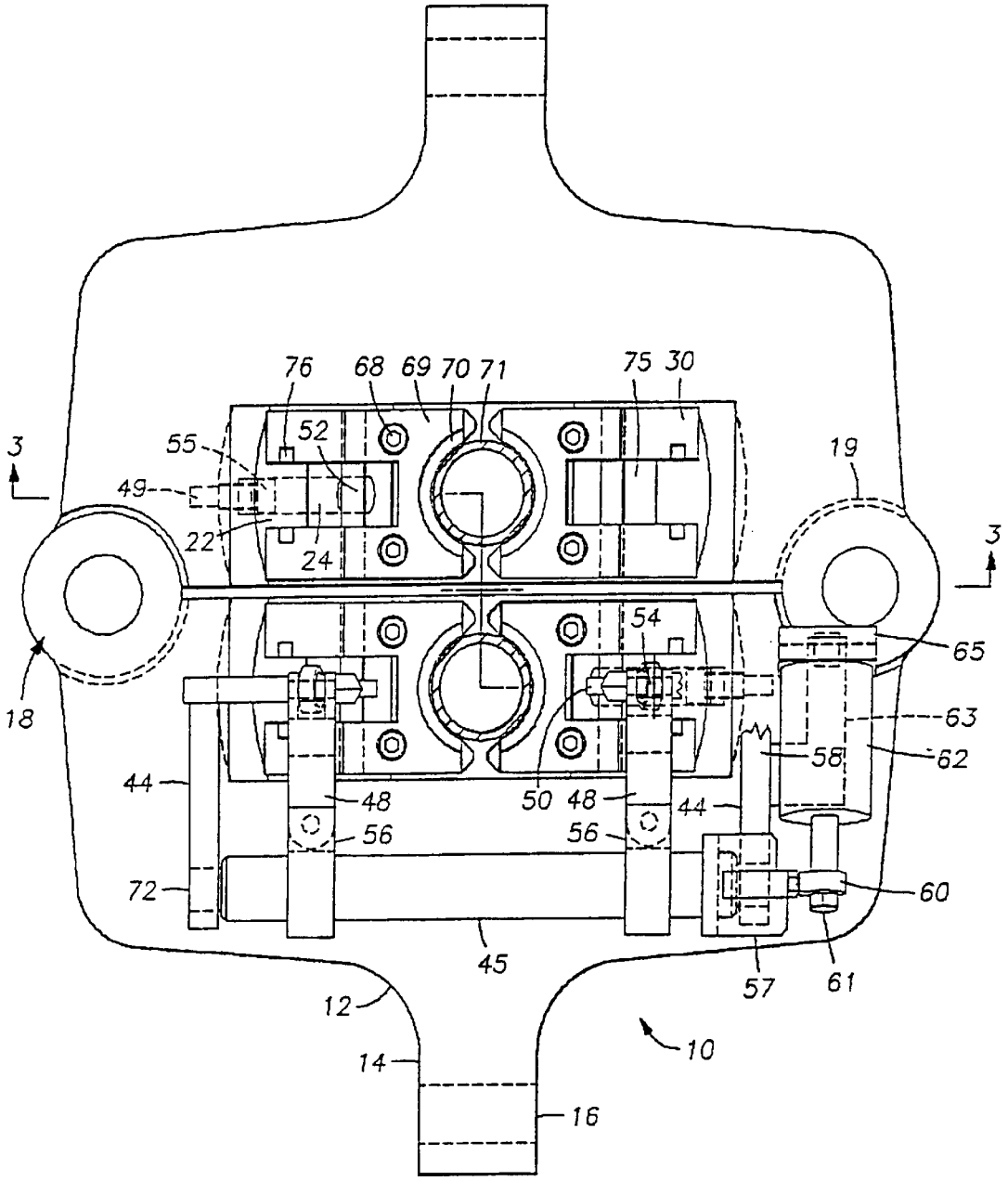
FIG. 2 is an overhead view of the preferred embodiment of the present invention showing only one slip lifting mechanism for purposes of clarity.

FIG. 2 is a top view of the pipe gripping apparatus (10) showing the housing (12) hingedly connected (18) and releasably secured (19).

Tubing string (71) is secured by gripping elements (70) which are secured, in part, by plate (69) which is connected to the slip (30) by bolts (68). Each slip (30) contains a slotted groove (76) which corresponds with the surface (22) of each slip carrier for radial movement of the slips (30).

Each slip carrier is rotationally secured to the downwardly curved internal surface of the housing (12) by a shoulder bolt (55) which passes through opening (24) in the slip carrier, and is threadedly connected to the housing (12).

Radial movement of the slips is permitted by utilizing a lifting mechanism (40). Each lifting mechanism (40), in its preferred embodiment, is attached at each end to a rod (52) transversely passing through each slip (30). A female rod end (50) is secured to each rod (52) through the opening of the slip (75), and at its opposite end is threadedly connected to a male rod end (54) which is attached to a lifting arm (48). The lifting arm (48) is likewise secured to the rotational tube

(45) by a bracket (56). In its preferred embodiment, the lifting mechanism comprises two lifting links (54) for engagement of the slips (30) on the tubing string (71). The rotational tube (45) rotates about an axle (72) which comprises a pivot block (44) at each end for supporting a securing arm (not shown) to each slip carrier. Connection of the lifting mechanism (40) to the slip carrier permits corresponding movement of the lifting mechanism (40) upon angular realignment of the slips when a tubing string is subjected to misalignment. At one end, the rotational tube (45) is connected to an actuator bracket (57) which translates movement from the pneumatic cylinder (62) to the rotational tube (45) by an end tube arm rod (60) which is connected to the pneumatic cylinder (62) by bolt (61). At its opposite end, the pneumatic cylinder (62) is secured to a cylinder bracket (65). The cylinder bracket (65) is fixed to a stabilizing bracket (63), which is in turn fixed to pivot block (44) for stabilization of the pneumatic cylinder (62).

In FIG. 3, a side view cross section of FIG. 2 is shown fully depicting one-half of the dual string pipe gripping for clarity. As shown, the apparatus (10) utilizes a hinged (18) housing (12). A tubing string (71) is shown exiting the housing (12) through a tapered opening (84). The tubing string is releasably secured by gripping elements (70) which are pivotally secured to each slip (30) by a rod longitudinally passing through the gripping elements for rotationally adapting to various pipe diameters. Plate (69) is secured to the top of each slip (30) by a pair of bolts (68) for enclosing the gripping elements (70) and securing the rod which pivotally secures the gripping elements. The lifting mechanism (40) depicts a pneumatic cylinder (62) secured to an axle (72) by a stabilizing bracket (63) and cylinder bracket (not shown) for stabilizing the pneumatic cylinder (62) during radial movement of the slips (30). At its opposite end, the pneumatic cylinder (62) is secured to an actuator bracket (57) by an end tube arm rod (60). The actuator bracket (57) is secured to the rotational tube (45) for radial movement of the slips (30). Simultaneous radial movement of each set of slips is accomplished when the rotational tube (45) translates radial movement of the slips (30) through a bracket (not shown) which connects lifting arms (48) to male rod ends (54), which are threadedly connected to female rod ends (50) and are secured to rod (52) which passes through each slip (30). The lifting mechanism (40) is attached to the upper portion at each securing arm (78) by bolts (80) for radial movement of the slips. Each securing arm (78) is secured by a screw (77) to each slip carrier. Therefore, each lifting mechanism (40) is capable of adjusting to any corresponding angular movement of the slip carriers (20) during operation. Each slip carrier (20) is capable of at least 5° angular adjustment in any direction or plane for adapting to the tubing string (71) when it becomes misaligned. Angular adjustment of the slip carrier (20) is accomplished by means of a shoulder bolt (55) which passes through an opening (24) in the slip carrier (20) and is secured to the housing (12) at 49. The degree of angular movement of each slip carrier (20) is dictated by the size and shape of the opening (24) in the slip carrier (20).

Figure 4:
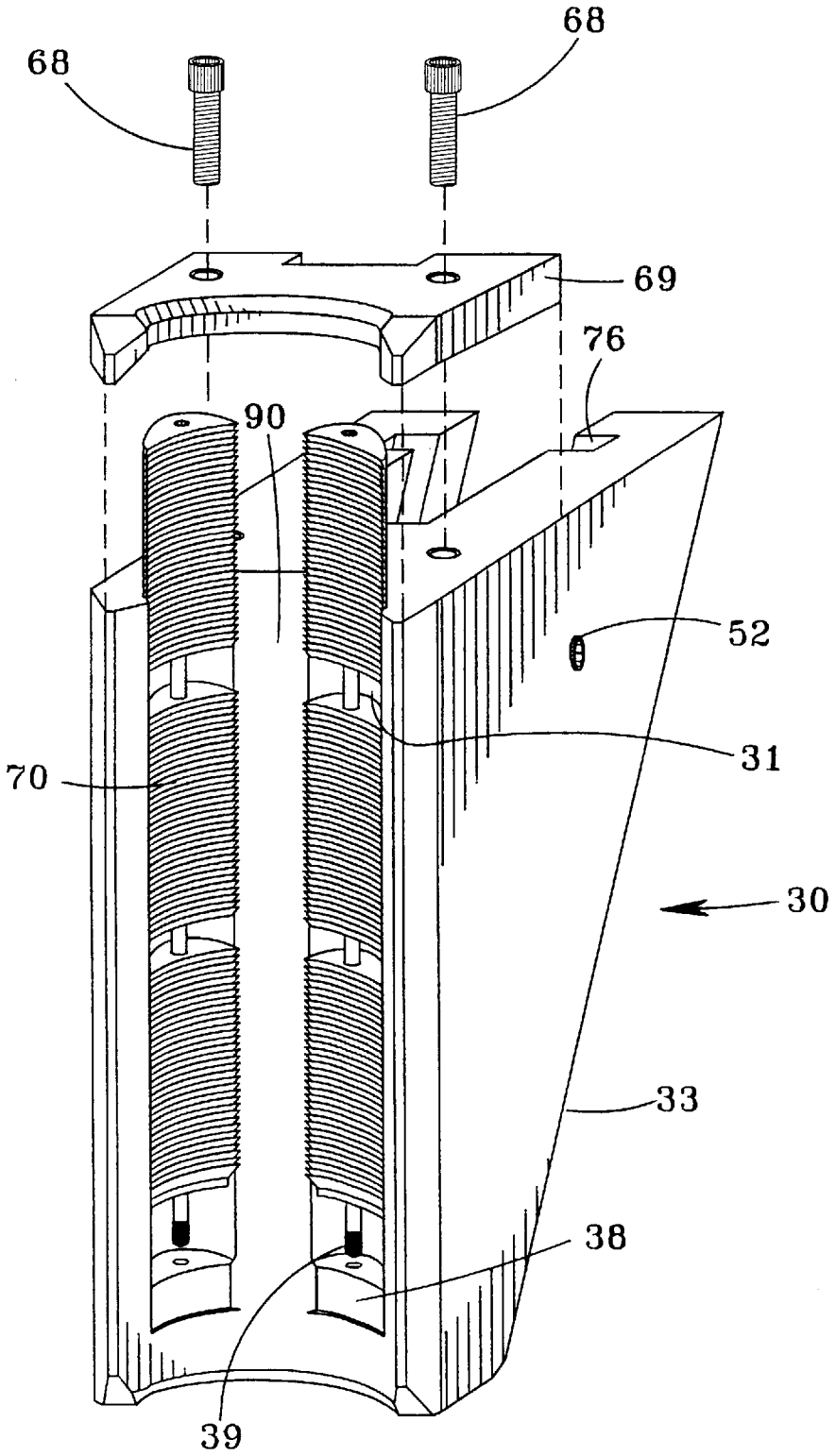
FIG. 4 is an isometric exploded view of the slip assembly generally shown as 30 in FIG. 1.

FIG. 4 shows an isometric exploded view of the slip (30) having an angularly disposed and downwardly inclined exterior surface (33) for slotted engagement of the slip carrier (not shown). A rod (52) is laterally disposed through the slip (30) for securing the lifting mechanism (not shown). Each slip (30) comprises a longitudinal surface (90) for housing a plurality of gripping elements which releasably secure the tubing string during operation. In its preferred embodiment, each longitudinal surface (90) of the slip (30) comprises a set of longitudinal, semi cylindrical, grooves (31) for housing a plurality of correspondingly contoured gripping elements (70) which are pivotally secured to the slip (30) by a rod (39) which is attached at its lowermost end to a rod insert (38) and at its uppermost end is contained by plate (69). Plate (69) is secured to the slip (30) by bolts (68). Rod (39) longitudinally passes through each set of gripping elements (70) which permits rotational adaptation of the gripping elements to various pipe diameters. Alternatively, each set of longitudinal, semi cylindrical, grooves located in the surface (90) of the slip (30) may comprise any shape or form capable of housing a plurality of opposingly contoured gripping elements capable of translational adaption to various pipe diameters.

Figure 5A:
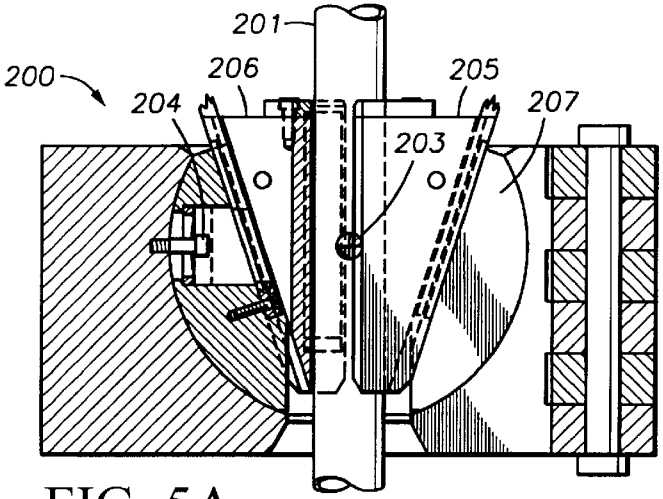
FIG. 5A is a cross sectional side view of the present invention under no adverse loading conditions.
Figure 5:
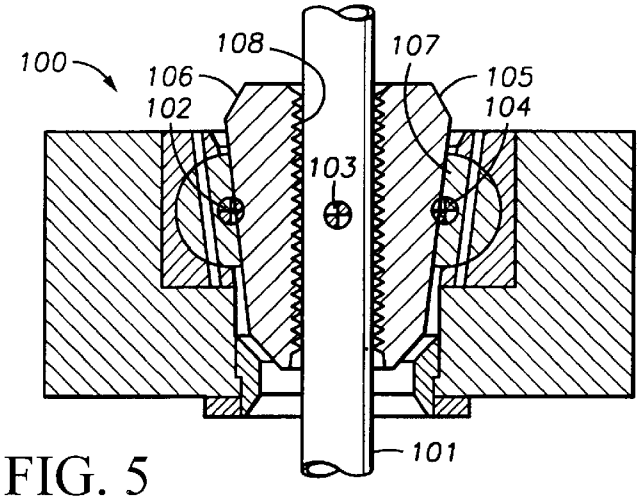
FIG. 5 (PRIOR ART)
FIG. 5 is cross sectional view of the prior art device under no adverse loading conditions.

FIGS. 5 and 5A are a comparison of the prior art single string gripping assembly device (FIG. 5) to the preferred embodiment of the present invention (FIG. 5A). FIG. 5 shows a single string gripping assembly device (100) securing the pipe (101) in the tubing string by means of slip bodies (105). Pivot member (107) is in rotational engagement with the slip body (105) to primarily provide rotational or angular adjustment as the pipe (101) rotates with respect to the vertical axis of the gripping assembly device (100). The centers of rotation of the slip carriers are 104 and 102. The center of rotation of the entire gripping assembly device (100) with respect to the pipe (100) is shown at 103. Similarly, the preferred embodiment of the pipe gripping apparatus (200) also depicts pipe (201) in a tubing string held secured by slips (205) which are rotationally engaged with slip carriers (207) and also depict a common center of rotation for the entire assembly consisting of slips and slip carriers within the stationary elevator or spider apparatus (200).

Figure 6A:
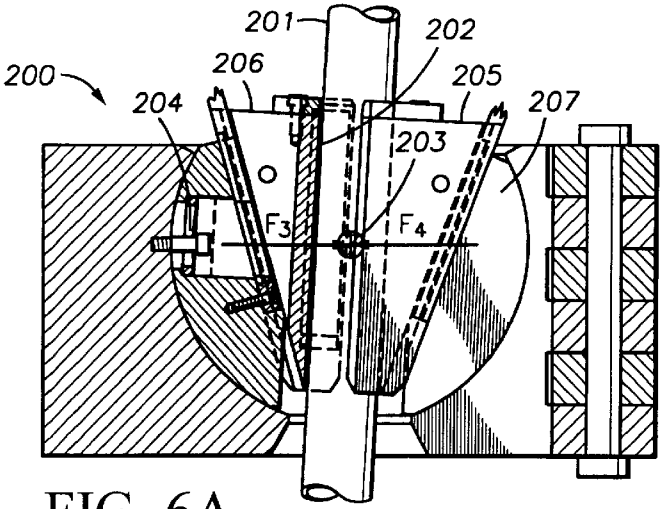
FIG. 6A is a cross sectional side view of the present invention under adverse loading conditions.
Figure 6:
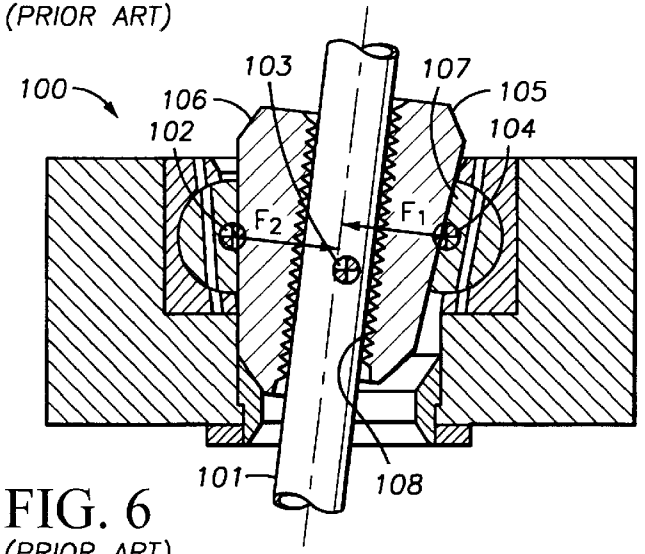
FIG. 6 (PRIOR ART)
FIG. 6 is a cross sectional side view of the prior art device under adverse loading conditions.

The distinctions and advantages of the present pipe gripping apparatus over that of the prior art are best viewed by a comparison of FIG. 6 (prior art) with FIG. 6A. FIG. 6 depicts a single string gripping assembly device (100) whereby the pipe (101) has been secured by the slip bodies (105) and the vertical axis of the gripping device (100) is not angularly aligned with the axis of the pipe (101). The resulting lateral loads on the pipe are symbolically shown as F1 and F2. Since the line of action forces F1 and F2 do not coincide, the unbalanced forces result in a bending moment being induced into the pipe body. Further angular rotation of the pipe axis with respect to the pipe gripping apparatus while gripping the pipe body results in vertical translation of the pipe surface with respect to the gripping surface (108) of the slips (105). This relative translational movement between the gripping surface (108) and pipe body under high contact loading results in undesirable damage to the pipe surface.

In FIG. 6A, the preferred embodiment of the pipe gripping apparatus (200) provides for significant movement of the slip carriers (207) through a shoulder bolt assembly (204) permitting rotational movement of the slips (205 and 206) about a common center of rotation (203). Accordingly, this "self alignment" of the present invention permits slip (205) to align directly opposite with slip (206) causing the line of action forces (F3 and F4) to coincide which avoids the inducement of a bending moment into the pipe body as is the case with the prior art shown in FIGS. 5 and 6. A further advantage of the present invention is due to the comon centers of rotation of pivot members 206 and 207 resulting in angular rotation of the pipe axis relative to the apparatus (200) vertical axis without relative vertical translational movement between the gripping surface of the slip (202) and the pipe surface. Consequently, pipe (201) is not subjected to unnecessary bending moments and abrasions as that depicted by the prior art in FIGS. 5 and 6 which is incapable of the angular adjustment once the pipe in the tubing string is secured by the device.

Whereas, particular embodiments of this invention have been described herein for purposes of an illustration only, and it will be evident to those skilled in the art that numerous variations of the details of the present invention may be made without departing from the invention as defined in the appended claims.

What is claimed is:

1. A pipe gripping apparatus for angularly adapting to misaligned pipe on one or more pipe strings, said apparatus comprising:

a housing having internal, opposing, downwardly curved surfaces therein and forming a longitudinal opening for passing a portion of at least one tubing string therethrough;

a plurality of slip carriers each having an exterior surface contoured to match said downwardly curved surface and having a downwardly inclined interior surface, each said slip carrier being in movable connection with one of said curved surfaces of said housing;

a plurality of slips having downwardly inclined exterior surfaces and longitudinal channels formed on an internal surface for holding gripping elements for gripping a portion of the pipe, each said slip being in sliding engagement with one of said slip carriers; and a lifting mechanism having a securing arm in connection between each pair of said opposing slips.

2. The apparatus of claim 1, wherein:

said housing comprises two halves hingedly connected and releasably connected, each said half separating at least one pair of opposing downwardly curved interior surfaces.

3. The apparatus of claim 2, wherein:

each half of said housing contains a pair of said slip carriers which rotate in relation to said housing when said slips are engaged with a misaligned pipe string.

4. The apparatus of claim 1, wherein:

said inclined interior surface of each said slip carrier forms a tongue; and said downwardly inclined exterior surface of each said slip defines a groove for engagement with said tongue of said slip carrier.

5. The apparatus of claim 4, further including:

a rod passing through each of said slips for connecting an end of said lifting mechanism thereto.

6. The apparatus of claim 1, wherein:

each said slip carrier is capable of angular movement for reducing bending moments in the pipe string held by said slips caused by misaligned pipe strings.

7. The apparatus of claim 1, wherein:

each lifting mechanism translates movement from each slip carrier to which it is secured to each slip to which it is connected.

8. A pipe gripping apparatus for angularly adapting to misaligned to misaligned pipe in one or more pipe strings, said apparatus comprising:

a housing comprising two halves hingedly connected together at one end and releasably securable together at the opposite end, each of said halves forming opposing downwardly curved interior surfaces, and said housing forming a longitudinal opening therethrough for disposing a portion of a pipe string;

a plurality of slip carriers having correspondingly contoured exterior surfaces each in rotational engagement with one of said downwardly curved surfaces of said housing, each said slip having a downwardly inclined interior surface;

a plurality of slips each having a downwardly inclined exterior surface for sliding engagement with said interior surfaces of said slip carriers, each said slip having an internal surface forming at least one longitudinal groove;

a plurality of gripping elements held within said grooves of said slip for engaging a portion of the pipe string; and a lifting mechanism secured between each said opposing slip carrier by a securing arm and connected to each said slip for simultaneous radial movement of each opposing set of said slips.

9. A pipe gripping apparatus for adapting to angular misaligned pipe in one or more tubing strings, said apparatus comprising:

a housing comprising two halves hingedly connected together at one end and releasably securable together at the opposite end, each of said halves forming opposing downwardly curved interior surfaces, and said housing forming a longitudinal opening therethrough for disposing a portion of a pipe string;

a plurality of slip carriers having correspondingly contoured exterior surfaces each in rotational engagement with one of said downwardly curved surfaces of said housing, each said slip carrier having a downwardly inclined interior surface;

a plurality of slips, each said slip having a corresponding downwardly inclined exterior surface in sliding engagement with one of said slip carrier downwardly inclined interior surfaces, and said slip having a longitudinal, semi-cylindrical, internal surface forming a pair of grooves containing a plurality of gripping elements adapted for gripping pipe strings having various diameters of pipe, wherein when said slips engage a misaligned string of pipe both said slip and said connected slip carrier rotate relative to said housing so as to reduce the bending moment on said gripped pipe; and a plurality of lifting mechanisms, each lifting mechanism secured between a pair of opposing said slip carriers by a securing arm, and connected to each said slip connected to said opposing slip carriers for simultaneous radial movement of each said set of slips.

10. The apparatus of claim 9, wherein:

each said lifting mechanism translates movement from each slip carrier to which it is secured to each slip to which it is connected.

11. A method for angularly adapting a pipe gripping apparatus to one or more misaligned pipe strings comprising the steps of:

enclosing one or more pipe strings within a housing;

gripping one or more of said pipe strings with slips having gripping elements mounted within channels formed by an internal surface of said slips;

angularly adapting said engaging slips to said misaligned string in relation to said housing via slip carriers rotationally connected between an interior curved surface of said housing and connected to said slips, and angularly adjust each said slip attached to said slip carriers interior downwardly inclined surface as each slip translates angular movement from said misaligned string to the slip carrier; and providing a lifting mechanism secured between a pair of opposing said slip carriers and connected between each said slip carrier carrying said slip secured by said lifting mechanism for radial movement of each said slip during running or retrieval of said string.

12. The step of angularly adapting to one or more misaligned strings of claim 11, wherein:

each said lifting mechanism radially lowers or raises a plurality of said gripping elements housed in said channels formed by said internal surface of said slips.

* * * * *